US005628070A

United States Patent [19]

Kefelian

[11] Patent Number: 5,628,070

[45] Date of Patent: May 13, 1997

[54] BURN PROTECTOR COVERING

[76] Inventor: Agnes R. Kefelian, 19513 Sedgefield Ter., Boca Raton, Fla. 33498

[21] Appl. No.: 582,049

[22] Filed: Jan. 2, 1996

Related U.S. Application Data

[63] Continuation-in-part of Ser. No. 353,698, Dec. 12, 1994, abandoned.

[51] Int. Cl.[6] ..... A41D 13/00; A41D 23/00

[52] U.S. Cl. ..... 2/174; 2/7; 2/DIG. 11

[58] Field of Search ..... 2/174, DIG. 11, 2/904, 7, 8, 81, 171, 209, 172, 206, 207, 200.1; 132/212

[56] References Cited

U.S. PATENT DOCUMENTS

| | | | |
|---|---|---|---|
| 2,124,431 | 7/1938 | Praytor | 2/174 |
| 2,446,122 | 7/1948 | Bills | 2/174 |
| 3,167,785 | 2/1965 | Uhl | 2/174 |
| 3,235,882 | 2/1966 | Coleman | 2/174 |
| 3,926,200 | 12/1975 | Losenno | 132/9 |
| 4,686,710 | 8/1987 | Marston et al. | 2/2 |
| 4,816,330 | 3/1989 | Freund et al. | 428/286 |
| 4,877,942 | 10/1989 | Raab | 219/225 |
| 4,964,175 | 10/1990 | Taylor | 2/174 |
| 5,023,954 | 6/1991 | Lyons | 2/174 |
| 5,035,006 | 7/1991 | Hetz et al. | 2/904 |
| 5,072,455 | 12/1991 | St. Ours | 2/81 |
| 5,141,189 | 8/1992 | Andrew | 248/154 |

FOREIGN PATENT DOCUMENTS

| | | | |
|---|---|---|---|
| 167657 | 2/1934 | Switzerland | 2/174 |

*Primary Examiner*—Amy B. Vanatta
*Attorney, Agent, or Firm*—Oltman, Flynn & Kubler

[57] ABSTRACT

A protective head covering is disclosed. The covering includes two bands of material each extending from opposite sides of a central band. The central band includes a top rounded edge for being positioned beneath the hairline on the back of the head for substantially abuting against the back of the neck. The central band includes a flap portion that extends down the back of the neck as well. The central band and each of the side bands can be formed from fire retardant and fire resistant material such as polytatrafluoroethylene also referred to as Teflon and the like, or can be shirting with a lining of aramid material which is very heat resistant. The side bands can be connected together by nylon type hooks and loops such as Velcro and the like. Alternatively, the side bands can be fastened together by buttons, snaps and the like. In use, the rounded top edge of the central band is positioned just beneath the hairline at the back of the head with the flap hanging down the back of the neck, the side bands each cover the ears and are connected at loose ends over the forehead by the fasteners. The covering can protect the neck, the ears and the forehead from burns and scorching that can occur when using a hot curler or hot comb.

1 Claim, 2 Drawing Sheets

BURN PROTECTOR COVERING

This application is a continuation-in-part of U.S. patent application Ser. No. 08/353,698, filed Dec. 12, 1994 now abandoned.

This invention relates to a protective covering, and in particular to a covering device for protecting the forehead, ears and back of the neck from being burned during curling of the hair.

BACKGROUND AND PRIOR ART

Curling ones own hair usually requires the manual dexterity of using an extremely hot curling iron or hot type comb when looking at a mirror. Such operations can often result in causing unwanted but self inflicted burns to the forehead, ears and back of the neck. For many years, people have risked scorching themselves when attempting to groom their own hair when using hot irons and hot combs.

Currently devices exist as shield-guards for shielding the hot areas of the curling irons from harming the user. See U.S. Pat. No. 3,962,200 to Losenno, U.S. Pat. No. 4,877,942 to Raab, and U.S. Pat. No. 5,141,189 to Andrew. However, each of these devices are restricted to being attached to the curling iron and hot comb themselves. Furthermore, it is still likely for the user to scorch portions of the ears, forehead and back of the neck with these devices.

Thus, there exists a need for protecting portions of one's ears, forehead and back of the neck from getting burned when using hot hair instruments.

SUMMARY OF THE INVENTION

The first objective of the present invention is to provide a covering for protecting the forehead from burns when a hot curing iron or hot comb is being used.

The second object of this invention is to provide a coveting for protecting the back of the neck from burns when a hot curling iron or hot comb is being used.

The third object of this invention is to provide a covering for protecting the ears from burns when a hot curling iron or hot comb is being used.

A preferred embodiment of the protective covering includes a central band having a rounded edge for being substantially positioned along the neck and a lower flap portion for running down the back of the neck. Attached to the left side of the central band is a first band. Attached to the tight side of the central band is a second band. Each of the bands are formed from a non flammable and heat resistant material formed from polytatrafluoroethylene such as Teflon and the like. The loose ends of the right and left band are fastenable together by nylon type hooks and loops such as Velcro. Alternatively, the fastening means can be a button and matching hole or snaps.

Although, the preferred method of application is for protecting ones ears, back of the neck and forehead from getting scorched from curling irons and hot combs, the invention can also be used for other applications. For example, chemical treatments to ones scalp can irritate sensitive areas, the subject invention can be used to protect against these other problems.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
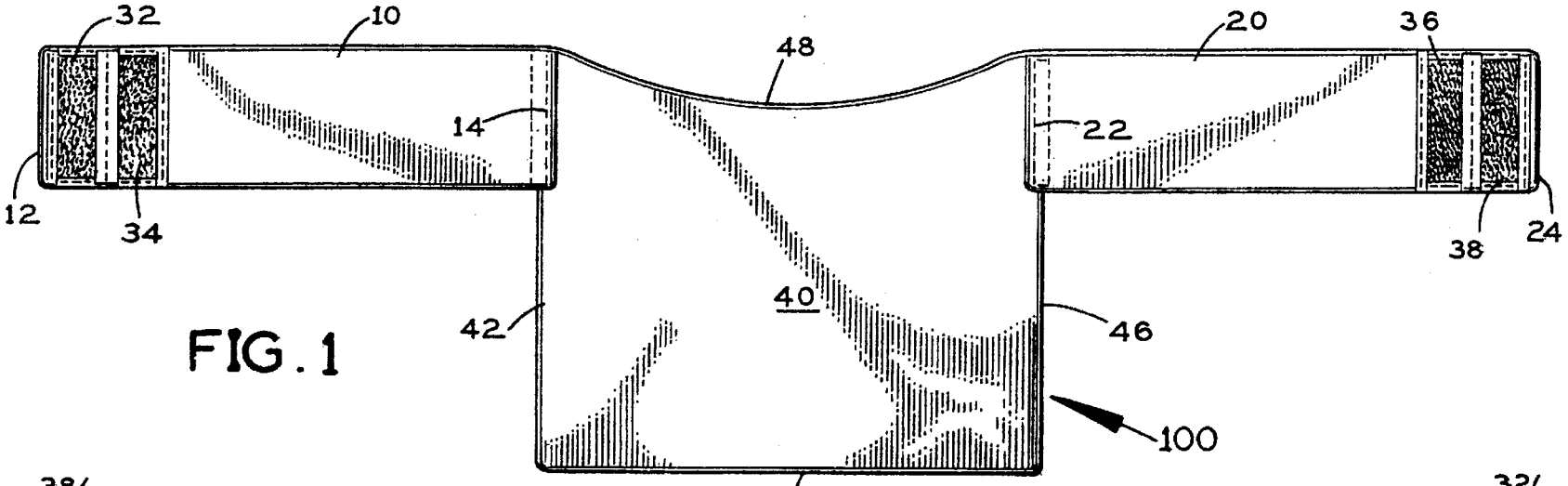
FIG. 1 shows a front view of the covering invention in an unravelled state.

FIG. 1 shows a front view of the covering invention 100 in an unravelled state. Protective covering includes a left side rectangular band 10, a central enlarged neck band 40, and a right side rectangular band 20, wherein the bands are made of a thin flexible material that can be heat resistant and non flammable, such as polytatrafluoroethylene, also known as Teflon, and the like. Neck band 40 is generally rectangular in shape but includes a rounded side edge 48 that can conform to the natural curvature along the back of a person's neck. The lower side of neck band 40 includes a flap portion 42, 44, and 46 which can extend down the back of the neck of the wearer. Left band 10 is connected to one side of neck band 40 at line 14 by sewing, fusing and the like. Similarly right band 20 can be attached to the other side of neck band 40 at point 22 by sewing, fusing and the like. Alternatively, the band materials of sections 10, 20 and 40 can be precut from a larger single piece of material. Attached to the face of the left band 10 and the right band 20 are nylon fasteners 32–38 such as hook and loop fasteners including Velcro and the like. The plural number of nylon fasteners allow users having different head sizes to be able to use the same protective covering.

Figure 2:
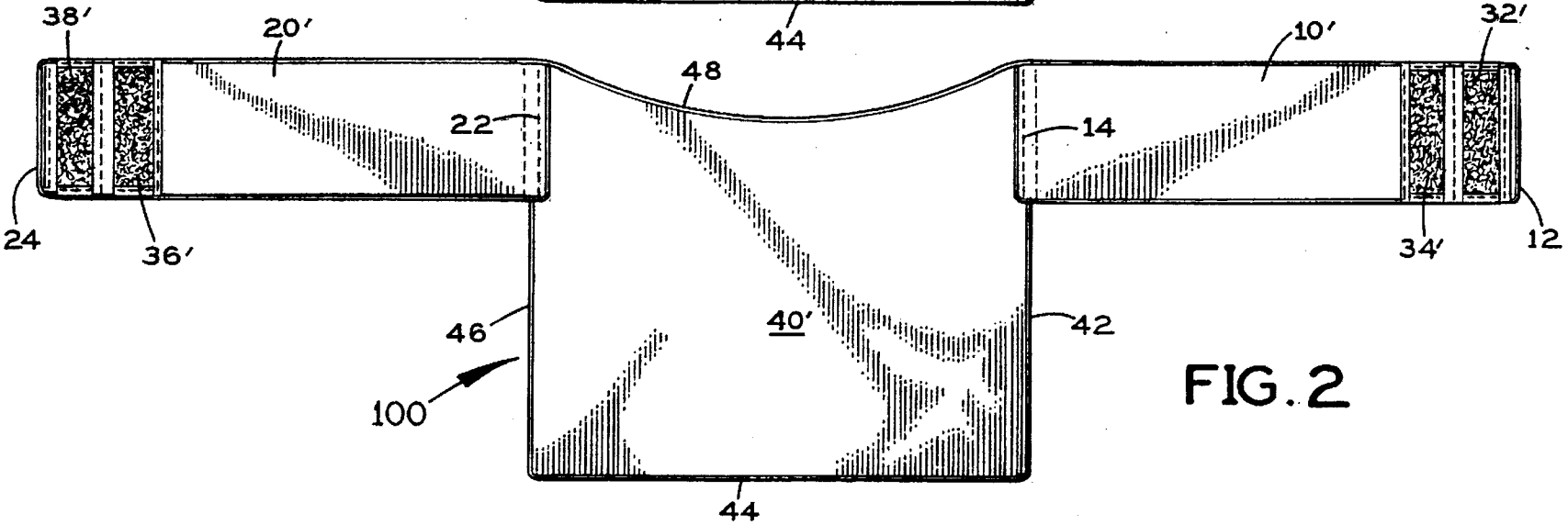
FIG. 2 shows a rear view of the protective coveting invention of FIG. 1.

FIG. 2 shows a rear view of the protective covering 100 invention of FIG. 1. Components 20' through 38' of FIG. 2 are similar to like components on the front side of the protective covering.

Figure 3:
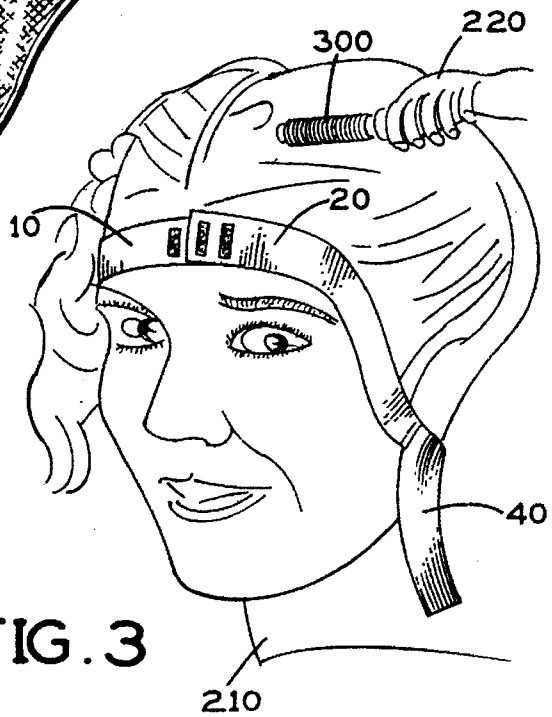
FIG. 3 shows the covering invention of FIG. 1 in position when used.

FIG. 3 shows the covering invention of FIG. 1 in position when used. Referring to FIGS. 1–3, a user 210 positions the rounded top edge 48 of the central band 40 just beneath the hairline at the back of the head with the flap 42–46 hanging down the back of the neck, the side bands 10 and 20 each cover the ears and are connected at loose ends over the forehead by the fasteners 32–36. The covering can protect the neck, the ears and the forehead from burns and scorching that can occur when using a hot tufter or hot comb.

Figure 4:
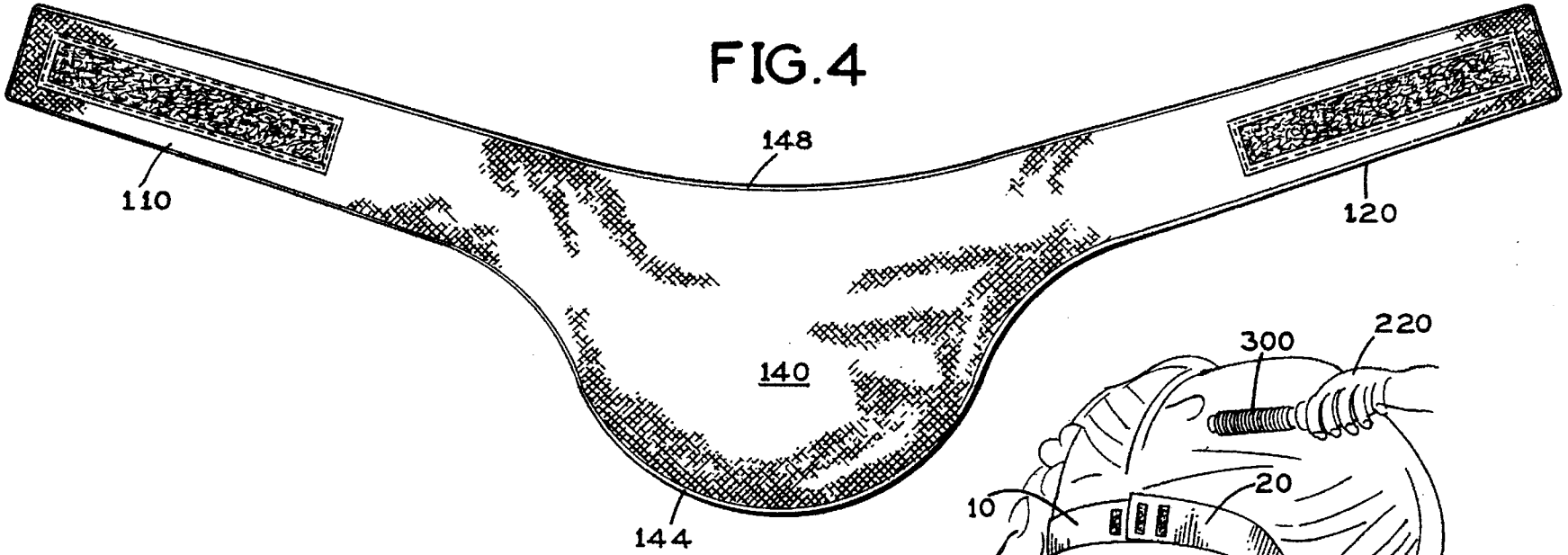
FIGS. 4 and 5 show another embodiment of the invention.
Figure 5:
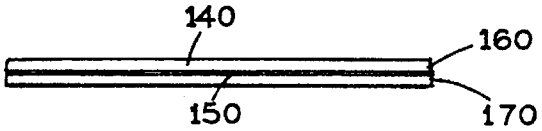

FIGS. 4 and 5 show another embodiment of the invention in which the bottom edge 144 of the central section 140 is curved, and the top edge 148 is also curved. The embodiment is very similar to the embodiment of FIG. 1. It has left band 110, right band 120 and central band 140. There is an internal lining 150 throughout, which is visible in FIG. 5 and which serves as a heat barrier. This internal lining is a heat resistant material known as aramid, and it preferably is 50% meta aramid and 50% colored, reprocessed meta aramid. The front and back outer layers 160 and 170 are preferably oxford cloth shirting. This embodiment has been found to be highly resistant to heat.

While the protective covering is pictured showing two nylon type fasteners on each side band of material, more or less type fasteners can be used as needed.

While the invention has been described as using nylon type hook and loop fasteners, other types of fasteners can be used such as but not limited to snaps, buttons and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A protective covering for the back of the neck, ears and forehead of a head of a person comprising:

a central band shaped to be positioned along the back of the neck of the person, said central band having a semi-rounded shape with a bottom curved edge and a top curved edge with said top curved edge being adapted to fit the top of the back of the neck and said bottom curved edge being adapted to extend to the base of the back of the neck;

said central band having a first side and a second side, both merging into said top curved edge and projecting angularly out of said central band;

a first band attached to said first side of said central band and projecting angularly outward and upward therefrom, a second band attached to said second side of said central band and extending angularly outward and upward therefrom opposite to said first band;

said first and second bands being adapted to cover the sides of the head and the ears of a user when fastened around the forehead of the user, but being narrower than said central band; and fastening means for allowing said first band and said second band to attach and detach together over said forehead;

said bands having an internal lining throughout of aramid material providing high heat resistance; and said bands having outer layers of oxford cloth shirting.

* * * * *